US011280065B2

(12) United States Patent
Loehr et al.

(10) Patent No.: US 11,280,065 B2
(45) Date of Patent: Mar. 22, 2022

(54) MULTI-POSITION HYDRAULIC COUPLING ATTACHMENT

(71) Applicant: Manitou Equipment America, LLC, West Bend, WI (US)

(72) Inventors: Thomas Joseph Loehr, Mt. Calvary, WI (US); Kyle David Rate, West Bend, WI (US)

(73) Assignee: MANITOU EQUIPMENT AMERICA, LLC, West Bend, WI (US)

( * ) Notice: Subject to any disclaimer, the term of this patent is extended or adjusted under 35 U.S.C. 154(b) by 387 days.

(21) Appl. No.: 16/546,994

(22) Filed: Aug. 21, 2019

(65) Prior Publication Data

US 2019/0376261 A1 Dec. 12, 2019

Related U.S. Application Data

(63) Continuation of application No. PCT/US2018/020171, filed on Feb. 28, 2018.

(60) Provisional application No. 62/467,655, filed on Mar. 6, 2017.

(51) Int. Cl.

| | |
|---|---|
| ***E02F 9/22*** | (2006.01) |
| ***E02F 3/36*** | (2006.01) |
| ***E02F 3/42*** | (2006.01) |

(52) U.S. Cl.

CPC ..... *E02F 9/2275* (2013.01); *E02F 3/3654* (2013.01); *E02F 3/422* (2013.01)

(58) Field of Classification Search

None

See application file for complete search history.

(56) References Cited

U.S. PATENT DOCUMENTS

| | | | | |
|---|---|---|---|---|
| 3,751,076 | A | 8/1973 | Thais et al. | |
| 4,304,077 | A * | 12/1981 | Muller | E02F 3/36 248/68.1 |
| 5,232,330 | A | 8/1993 | Rae et al. | |
| 6,196,595 | B1 * | 3/2001 | Sonerud | E02F 3/3631 285/26 |
| 2005/0184510 | A1 | 8/2005 | Langenfeld et al. | |
| 2006/0245903 | A1 | 11/2006 | Albright et al. | |
| 2010/0092233 | A1 | 4/2010 | Roan et al. | |

(Continued)

FOREIGN PATENT DOCUMENTS

| | | |
|---|---|---|
| EP | 2347054 | 7/2011 |
| JP | 2008049253 | 3/2008 |

(Continued)

OTHER PUBLICATIONS

European Patent Office, "Extended European Search Report," issued in connection with European Patent Application No. 18764733.4, dated Nov. 23, 2020, 7 pages.

(Continued)

*Primary Examiner* — Gerald McClain

(74) *Attorney, Agent, or Firm* — Husch Blackwell LLP

(57) ABSTRACT

An improved arrangement for multi-position attachment points for hydraulic implement coupling. Hydraulic hoses associated with an implement attachment assembly may be removably coupled to a lift arm when in a non-operating configuration, and removably coupled to the attachment assembly when in an operating configuration.

16 Claims, 9 Drawing Sheets

(56) References Cited

U.S. PATENT DOCUMENTS

| | | | | |
|---|---|---|---|---|
| 2012/0319397 | A1* | 12/2012 | Mahrenholz | E02F 3/3654 285/308 |
| 2013/0257095 | A1* | 10/2013 | Kurauchi | E02F 9/0891 296/187.01 |
| 2021/0238826 | A1* | 8/2021 | Marinescu | E02F 9/2267 |

FOREIGN PATENT DOCUMENTS

| | | |
|---|---|---|
| JP | 2014141855 | 8/2014 |
| KR | 20120000394 | 1/2012 |

OTHER PUBLICATIONS

International Searching Authority, "International Search Report and Written Opinion," issued in connection with International Patent Application No. PCT/US2018/020171, dated Jun. 27, 2018, 11 pages.

* cited by examiner

MULTI-POSITION HYDRAULIC COUPLING ATTACHMENT

CROSS-REFERENCE TO RELATED PATENT APPLICATION

This application is a continuation of International Patent Application No. PCT/US2018/020171 filed on Feb. 28, 2018, which claims the benefit of and priority to U.S. Provisional Application No. 62/467,655 filed on Mar. 6, 2017, which are incorporated herein by reference in their entireties.

FIELD OF THE INVENTION

This invention generally relates to improved layout for hydraulic lines associated with heavy equipment. More specifically, the invention relates to a multi-position attachment mechanism for hydraulic lines subject to damage and repeated flexure during machine operation.

BACKGROUND OF THE INVENTION

Many types of heavy equipment (loaders, skid steers, boom handlers, etc.) are employed in a wide variety of tasks including farming and construction. Many such vehicles operate using hydraulic power as a motivating source of power. In vehicles with lift arms, an attachment interface is typically used to allow the removable coupling of different implements to a vehicle to accomplish different tasks. Some implements require hydraulic and/or electrical power, while other implements do not. Therefore, many attachment interfaces are provided with hydraulic power via flexible hoses. However, these lines may become damaged during use of non-hydraulic implements. Therefore, improved arrangements for providing hydraulic power during some operations, but protecting the hydraulic hoses during other operations, is desired.

The invention provides such an arrangement. These and other advantages of the invention, as well as additional inventive features, will be apparent from the description of the invention provided herein.

BRIEF SUMMARY OF THE INVENTION

In one aspect, the invention provides a lift arm with an implement attachment interface. The attachment interface is rotatable with respect to the lift arm. The lift arm includes a first hydraulic hose having a first end and a second end. The first end is in fluid connection with a first hydraulic fitting in a fixed relation to the lift arm, and the second end includes a quick connect hydraulic fitting. The second end is coupled to a first mounting plate. A first bracket is affixed to the lift arm and a second bracket is affixed to the implement attachment interface. The first mounting plate is moveable between the first bracket and the second bracket, and is removably securable to the first bracket and the second bracket.

In some embodiments, the first bracket is in a static relationship to the lift arm during rotation of the attachment assembly, and the second bracket is in a rotational relationship to the lift arm during rotation of the attachment assembly.

In some embodiments, the mounting plate is slidably receivable by the first bracket and the second bracket without decoupling the first hydraulic hose from the first mounting plate.

In some embodiments, the lift arm further comprises a second hydraulic hose having a third and fourth end. The third end is in fluid connection with a second hydraulic fitting in a fixed relation to the lift arm, and the fourth end includes a quick connect hydraulic fitting. The fourth end is also coupled to the first mounting plate. The quick connect fitting of the first hydraulic hose is a hydraulic fluid supply fitting, and the quick connect fitting of the second hydraulic hose is a hydraulic fluid return fitting.

In some embodiments, the lift arm also includes a third hydraulic hose having a fifth end and a sixth end. The fifth end is in fluid connection with a third hydraulic fitting in a fixed relation to the liftarm, and the sixth end includes a quick connect hydraulic fitting. The sixth end is coupled to a second mounting plate. The lift arm also includes a third bracket affixed to the lift arm, and a fourth bracket affixed to the implement attachment interface. The second mounting plate is moveable between the third bracket and the fourth bracket, and the second mounting plate is removably securable to the third bracket and the fourth bracket.

In a further embodiment, the second mounting plate is slidably receivable by the third bracket and the fourth bracket without decoupling the third hydraulic hose from the second mounting plate. The third hydraulic hose may be a case drain hose.

In another aspect, the invention provides a method of selectively securing hydraulic hoses of a vehicle during operation. The method includes the step of providing a vehicle having a lift arm with an implement attachment interface rotatable with respect to the lift arm. In another step, a first bracket is provided on the lift arm. The first bracket is configured to receive a mounting plate coupled to a first flexible hydraulic hose. Additionally, a second bracket is provided on the implement attachment interface. The second bracket is also configured to receive the mounting plate coupled to the first flexible hydraulic hose. The mounting plate and first hydraulic hose are selectively secured to the first bracket when a non-hydraulic implement is coupled to the implement attachment interface, and selectively secured to the second bracket when a hydraulic implement is coupled to the implement attachment interface. The first hydraulic hose is coupled to the hydraulic implement.

In one embodiment, the method further includes the step of providing two J-shaped recesses on each of the first bracket and the second bracket, each two J-shaped recesses defining a protrusion therebetween.

In yet another aspect, a kit for providing a multi-position coupling arrangement for a lift arm with a rotatable attachment assembly is provided. The kit includes a first bracket and a second bracket, and a mounting plate selectively securable to the first bracket and second bracket. The mounting plate includes an annular opening having a diameter between 0.25 inches and 1.25 inches, and further includes a plate opening for a securement pin. Each bracket has a generally flat profile and two recesses defining a protrusion therebetween. Each protrusion also has a protrusion securement pin opening. The plate securement pin opening and the protrusion securement pin opening are coaxially aligned when the mounting plate is secured to the first bracket or the second bracket. The kit may also include a securement pin. In some embodiments, the recesses are opposed J-shaped recesses. In some embodiments, the kit may also include two hydraulic hoses.

In a further embodiment, the kit also includes a third bracket and a fourth bracket, and a second mounting plate selectively securable to the third bracket and fourth bracket. The second mounting plate includes an annular opening having a diameter between 0.25 inches and 1.25 inches, and further includes a plate opening for a securement pin. The plate securement pin opening and the protrusion securement pin opening are coaxially aligned when the second mounting plate is secured to the third bracket or the fourth bracket. The kit may also include a securement pin. In some embodiments, the recesses are opposed J-shaped recesses.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
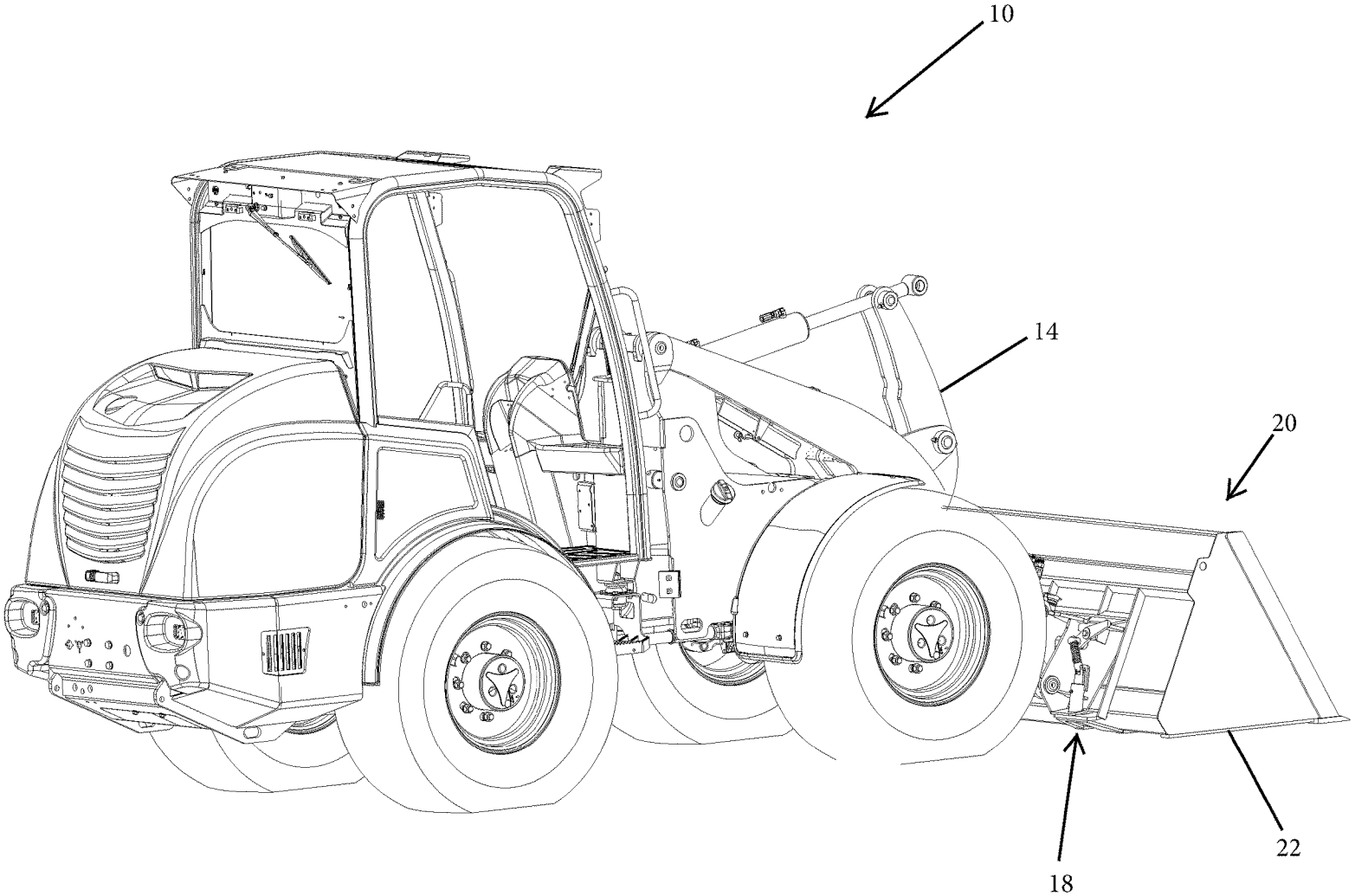
FIG. 1 is a side perspective view of an articulated front-end loader including a Z-bar lift arm and an attachment assembly comprising an embodiment of the present invention.
Figure 2:
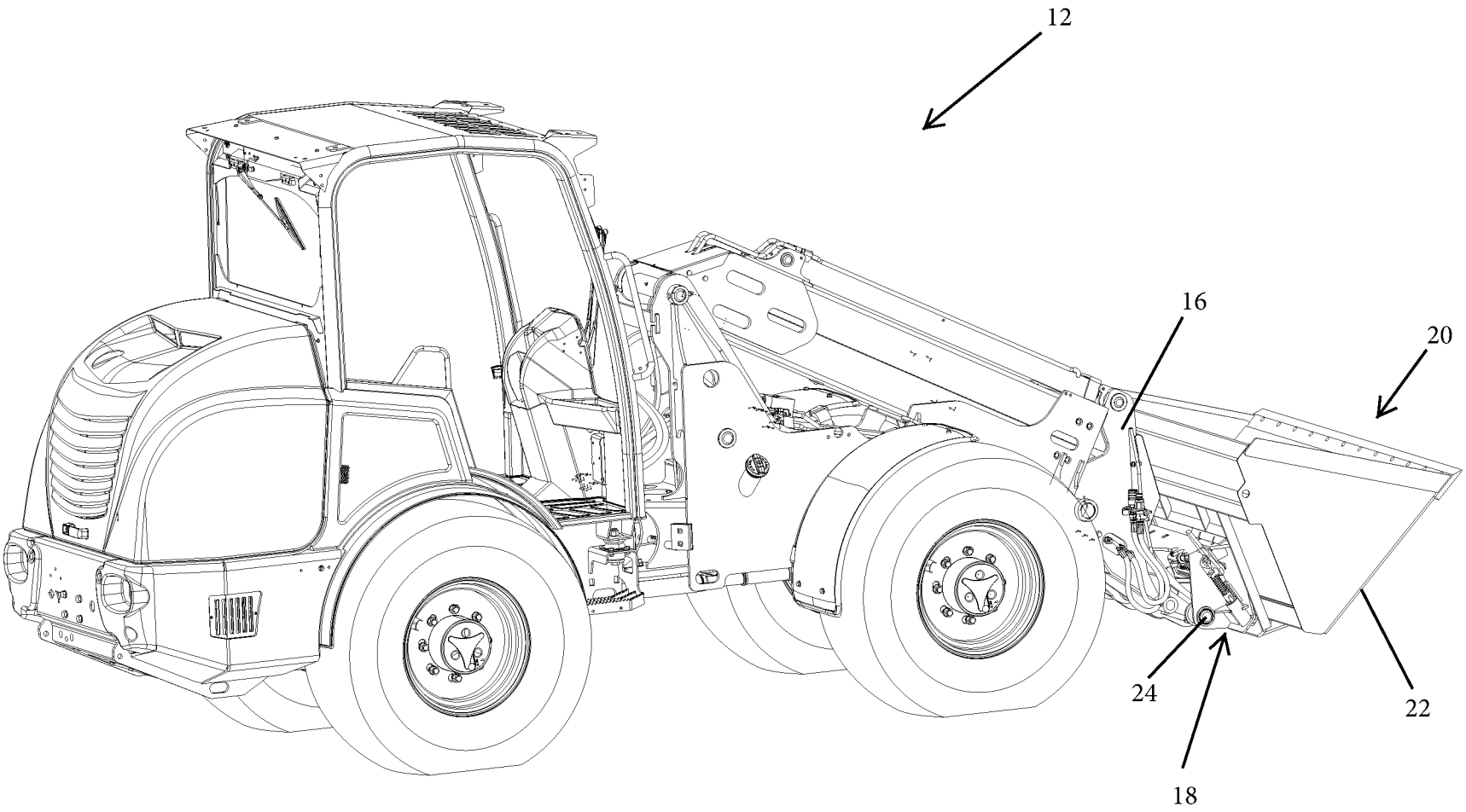
FIG. 2 is a side perspective view of an articulated front-end loader including a telescoping lift arm and an attachment assembly having an embodiment of the present invention.

Referring to FIGS. 1 and 2, wherein like numbers refer to like elements, articulated front end loaders 10 and 12 are shown. Loader 10 is a "Z-Bar" type front end loader having a movable arm, shown here as a z-bar lift arm 14. Loader 12 is a telescoping type front end loader having another type of movable arm, shown here as a telescoping lift arm 16. Movable arms such as z-bar lift arm 14 and telescoping lift arm 16 are typically provided with an attachment assembly 18 for attaching a variety of implements to the front end loader. Attachment assemblies as described herein may also be provided on other types of heavy equipment, for example skid loaders, track loaders, and telescopic handlers.

Attachment assembly 18 is typically tilted about a pivot point of z-bar arm 14 or telescoping lift arm 16 by hydraulic actuation, as is generally known in the art. To tilt an implement, the attachment assembly 18 is rotated about an axis parallel to the ground surface and perpendicular to the center line of the front end loader. For example, FIG. 1 shows bucket 22 of loader 10 in a rotationally lowered position relative to the ground surface plane, while FIG. 2 shows bucket 22 of loader 12 in a rotationally raised position relative to the ground surface plane. In many front end loaders, the attachment assembly 18 may be rotated in an arc of at least 150 degrees around pivot point 24, and preferably about 180 degrees around pivot point 24, thereby providing a substantial range of motion for an associated implement 20 and allow for loading, scooping, scraping, and emptying operations.

Attachment assembly 18 may be operationally coupled to a variety of functional implements 20, shown in FIGS. 1 and 2 as a bucket 22. Other types of implements 20 that may be coupled to attachment assembly 18 include, without limitation, augers, bale movers, brooms, grapple buckets, rotary mowers, pallet forks, rakes, snow blowers, and material spreaders. Some implements, such as bucket 22, do not require either auxiliary hydraulic power or electrical power. Other types of implements, such as augers, grapple buckets, mowers, and material spreaders, may require auxiliary hydraulic power or electrical power provided by loaders 10 or 12. Still other types of implements, such as snow blowers, may require both auxiliary hydraulic power and electrical power provided by loaders 10 or 12. Accordingly, auxiliary hydraulic hoses and electrical power lines are typical features of attachment assemblies of lift arms of various types of heavy equipment, such as front end loaders 10 and 12.

In typical pieces of heavy equipment having a movable lift arm and a rotatable attachment assembly, hydraulic and/or electrical power may be supplied to an attached implement via quick-connect hydraulic couplings and/or electric couplings (plugs, sockets, etc.) attached to the rotatable attachment assembly. In such designs, two approaches are commonly used. More commonly, flexible connection hoses and/or electrical lines are used to route pressurized hydraulic fluid from a location on the movable arm to a hydraulic supply coupling location on the attachment assembly. Typically, such hoses and lines are routed in a "U" shape underneath the pivot point connection between the lift arm and the attachment assembly. However, flexible hoses and lines installed in this configuration are known to suffer excessive wear during operation of many types of implements, such as bucket 22, that do not actually require hydraulic power. Wear may be caused by repeated flexure of hoses and lines during operation of the implement 20, and may be exacerbated by abrasive wear due to contact with materials loaded with a bucket-type implement, for example stone, concrete, scrap metal, and the like.

Alternatively, hydraulic hoses and electrical lines may be terminated by a quick-connect on the lift arm rather than the attachment assembly. However, this configuration does not provide hydraulic and/or electrical power proximate to the implement attachment point. Accordingly, a powered implement will require longer hydraulic and electric lines, which may be dangerously exposed to pinch points or entanglement during operation of the implement 20. This problem may be particularly severe during operations where the attachment assembly 18 and coupled implement 20 are significantly rotated. Thus, this configuration is generally viewed as less desirable for many front-end loader designs.

Figure 3:
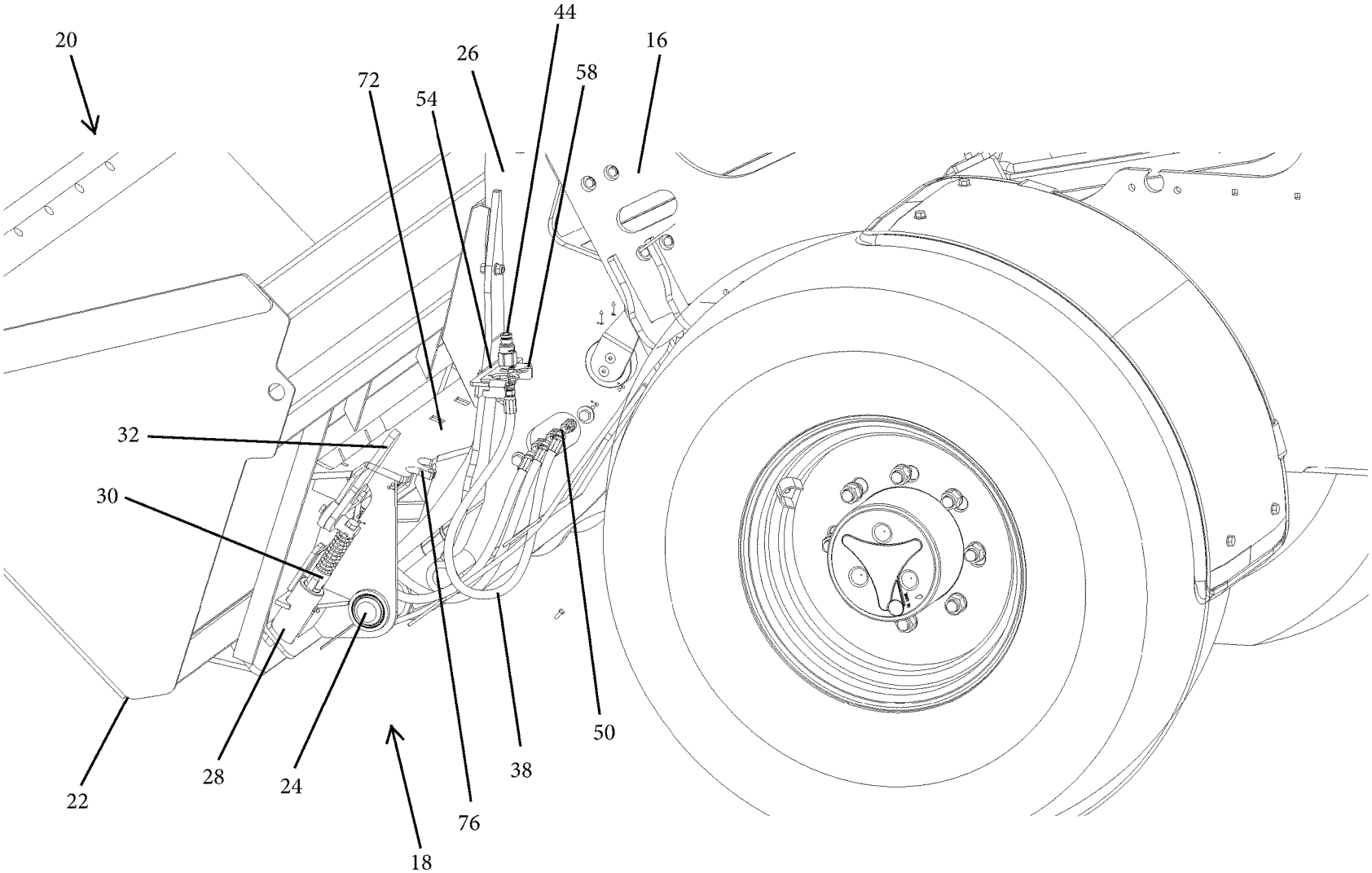
FIG. 3 is a detail view of the left side of an attachment assembly having an embodiment of the present invention.
Figure 4:
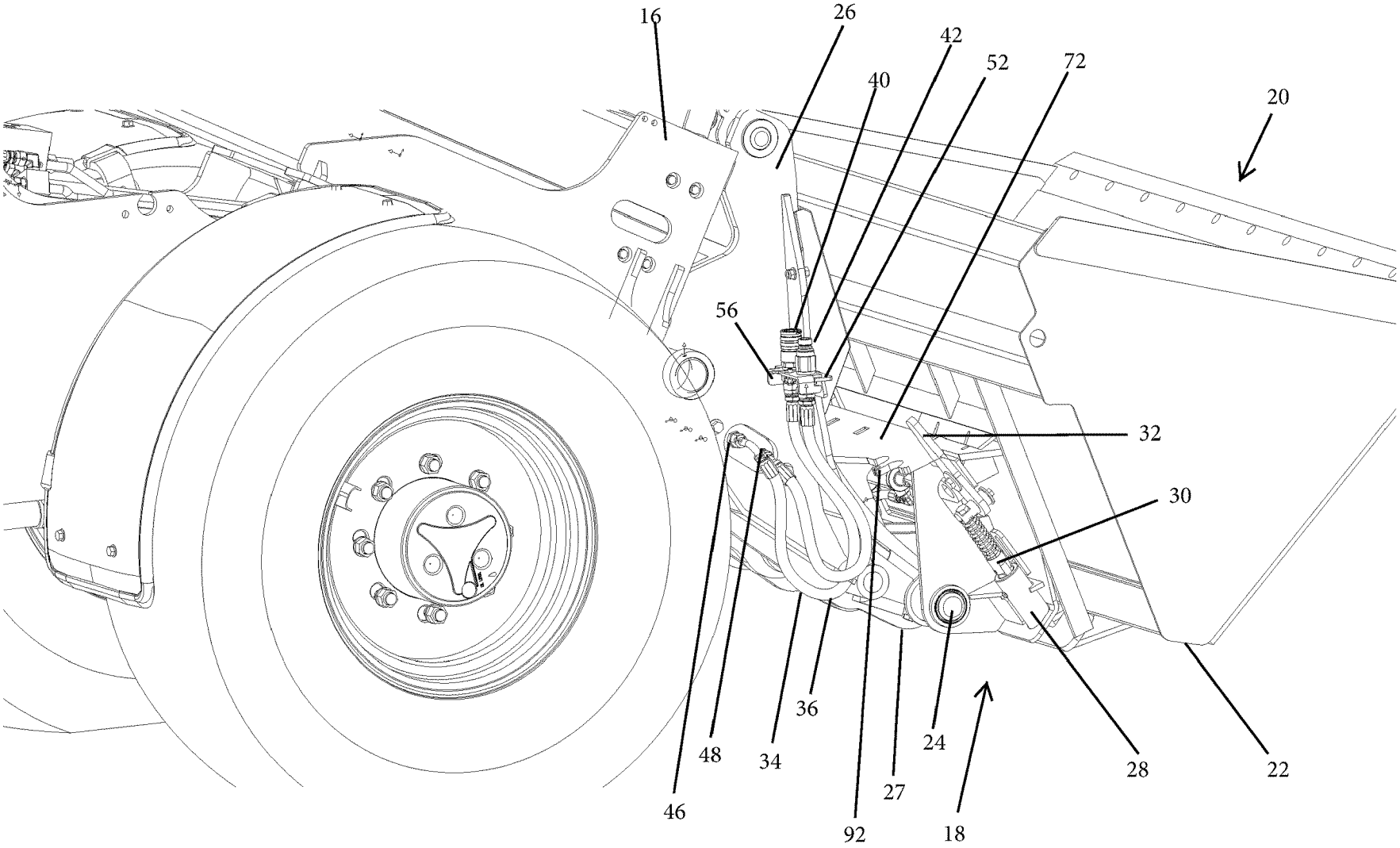
FIG. 4 is a detail view of the right side of an attachment assembly having an embodiment of the present invention.

Referring to FIGS. 3 and 4, left and right side views of an attachment assembly 18 including an embodiment of the present invention are shown. As shown, attachment assembly 18 is coupled to the front 26 of extendible lift arm 16.

Attachment assembly 18 may be removably coupled to implements 20 by lifting the implement with flanges 17 (best shown in FIG. 8), as is generally known in the art. In the preferred embodiments shown herein, attachment assembly 18 includes a hydraulically-actuated pin retention system 28 to secure an implement 20 to attachment assembly 18 during operation. Pin retention system 28 includes a securement pin 30 and an indicating arm 32. Additional hydraulic lines 31, 33 are operatively coupled to the hydraulically-actuated pin retention system 28 of attachment assembly 18 (best shown in FIG. 5). In other embodiments, a manually-actuated lever pin retention system may be used.

In the embodiment shown, auxiliary hydraulic power is provided by hydraulic hoses 34, 36, and 38. In this configuration, hoses 34 and 36 provide pressurized flow and return of hydraulic fluid via quick-connect couplings 40, 42 located on the right side of front 26 of lift arm 16. Hydraulic power may thereby be provided to an implement 20 when operably connected to attachment assembly 18. Hoses 34, 36 are removably coupled to permanent fittings 46, 48 of lift arm 16 at the ends distal to quick-connect couplings 40, 42. Quick-connect couplings 40, 42 of hoses 34, 36 are removably affixed to a movable attachment plate 52, as shown in more detail in FIGS. 8-9.

Attachment plate 52 is shown in FIG. 4 in a non-operating position, wherein the attachment plate 52 is coupled to right bracket 56. Hoses 34, 36 are thereby placed in a static position with respect to front end 26 of lift arm 16, and distal from attachment assembly 18. In a preferred embodiment, the lowest loop of hoses 34, 36 is above the bottom point 27 of front 26 of lift arm 16. Accordingly, operation and rotation of attachment assembly 18 will not cause flexure of hoses 34, 36 and/or subject hoses 34, 36 to mechanical wear from contact with the ground or materials being handled.

On the left side of front 26 of lift arm 16, a hydraulic case drain hose 38 is shown having a quick-connect coupling 44. Case drain hose 38 may be used to provide pressure relief and hydraulic fluid drainage from an implement 20 when operably connected to attachment assembly 18. Hose 38 is removably coupled to a permanent fitting 50 of lift arm 16 at the end distal to quick-connect coupling 44. Quick-connect coupling 44 of hose 38 is removably affixed to a movable attachment plate 54, as shown in more detail in FIGS. 8-9. Additionally, an implement plug end of an electrical supply line (not shown) may be coupled to movable attachment plate 54, and the distal end of the electrical supply line may receive power from front end 26 of lift arm 16. The implement plug end may be any configuration known in the art, such as a 14-pin connector.

Attachment plate 54 is shown in FIG. 3 in a non-operating position, wherein the attachment plate 54 is coupled to left bracket 58. Hose 38 and an electrical line (if present) are thereby placed in a static, raised position with respect to front end 26 of lift arm 16, and distal from attachment assembly 18. In a preferred embodiment, the lowest loop of hose 38 is above the bottom point 27 of front 26 of lift arm 16. Accordingly, operation and rotation of attachment assembly 18 will not cause flexure of hose 38 and/or subject hose 38 to mechanical wear from contact with the ground or materials being handled.

Right and left brackets 56, 58 may be metal brackets that are welded or bolted to front 26 of lift arm 16. Alternatively, brackets 56, 58 may be integrally formed on front end 26 of lift arm 16. Generally, brackets 56, 58 are positioned above and to the rear of attachment assembly 18, such that impingement of debris (dirt, mud, etc.) on quick-connects 40, 42, 44 is minimized.

In the embodiment shown, quick-connects 40, 42, and 44 are essentially vertical when stowed in the non-operating position. In other embodiments, the quick-connects may be tilted backwards to shed any foreign materials (mud, dust, etc.) that may impinge on the quick connects. In other embodiments, brackets 56, 58 may further include a planar cover positioned above the quick-connects. In still other embodiments, brackets 56, 58 may be provided with a cover, for example a rubber boot, to prevent foreign materials from impinging on the quick-connects.

Figure 5:
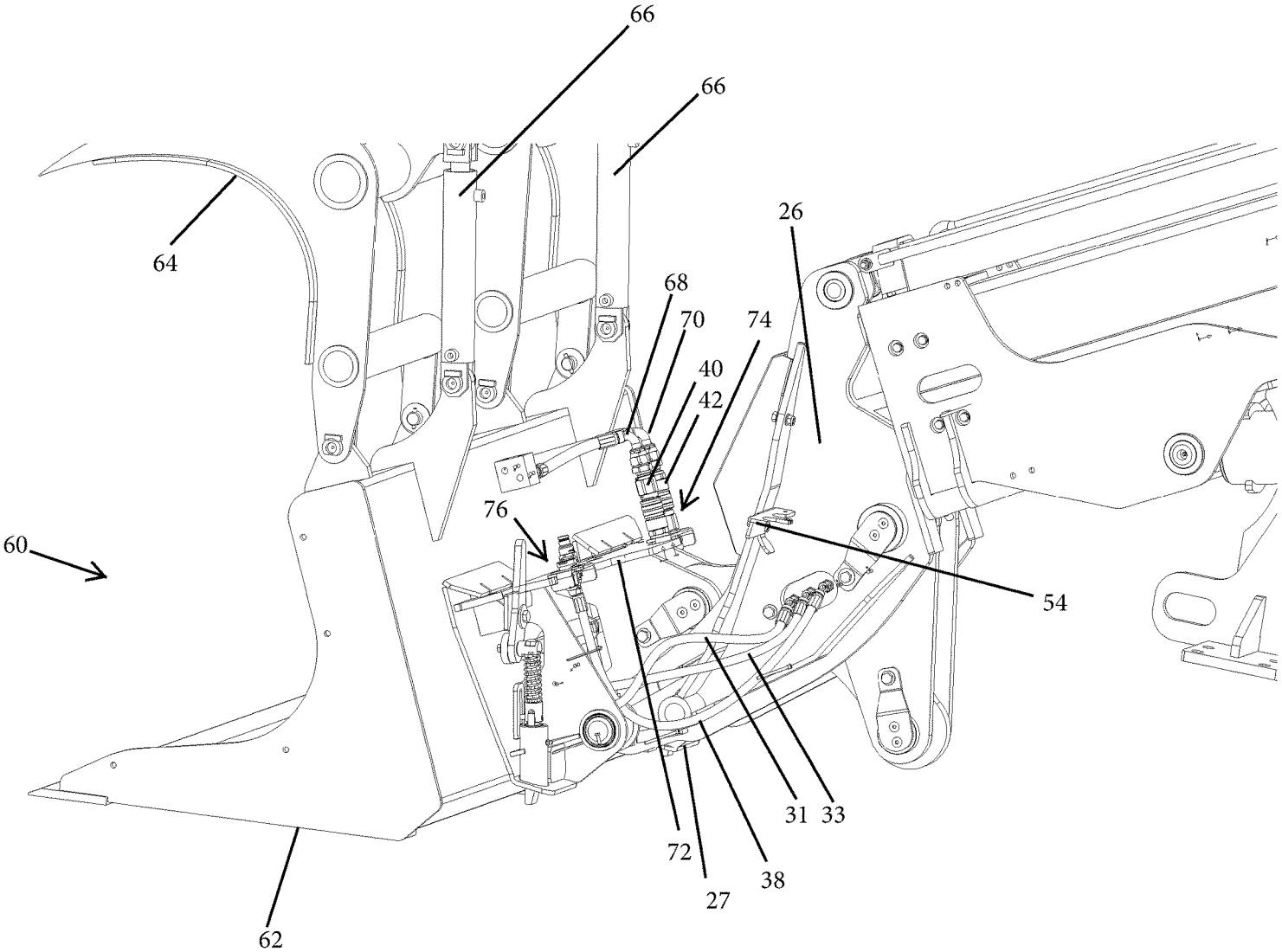
FIG. 5 is a detail view of the left side of an attachment assembly having an embodiment of the present invention.
Figure 6:
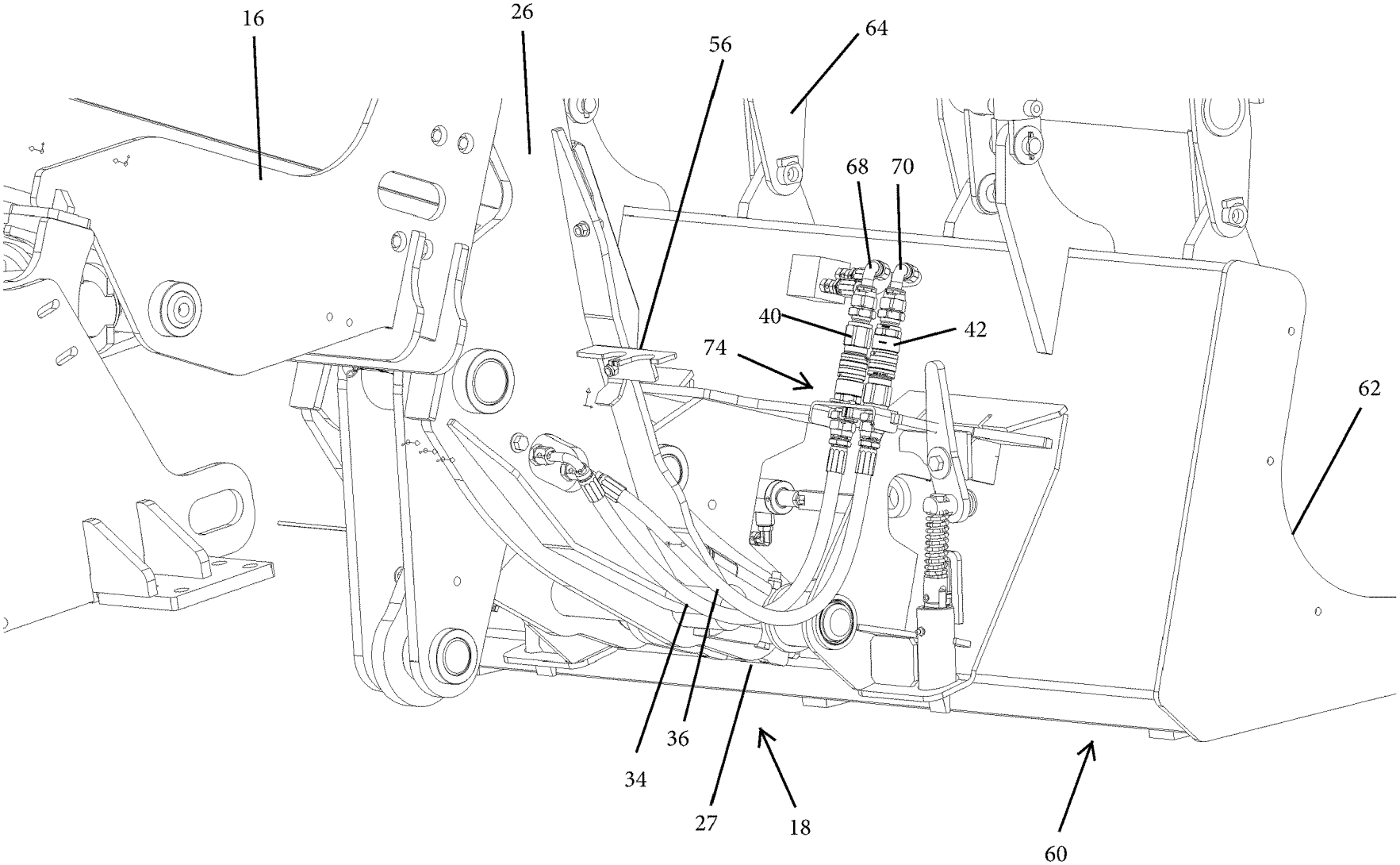
FIG. 6 is a detail view of the right side of an attachment assembly having an embodiment of the present invention.
Figure 7:
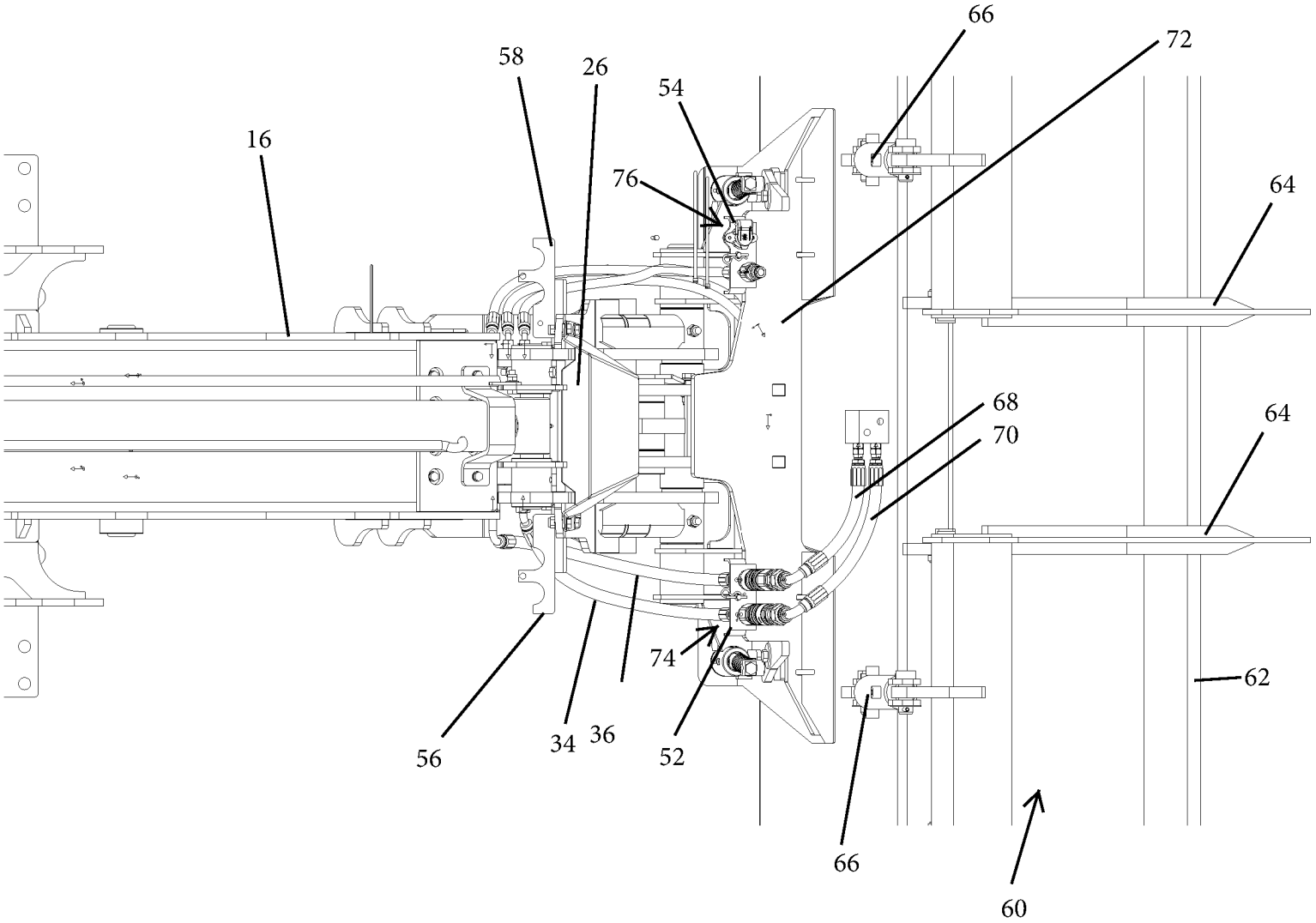
FIG. 7 is a detail top view of an attachment assembly having an embodiment of the present invention.

Referring to FIGS. 5-7, an implement 20 using hydraulic power, shown as a grapple bucket 60, is operationally affixed to attachment assembly 18. Grapple bucket 60 includes a lower bucket portion 62 and grapple 64. Grapple 64 may be opened and closed by actuation of hydraulic cylinders 66. Grapple bucket 60 further includes implement hydraulic hoses 68, 70 in fluid connection with hydraulic cylinders 66.

Attachment assembly 18 includes a right hose securement location 74 and a left hose securement location 76. In a preferred embodiment, securement locations 74, 76 are brackets positioned on structural top bar 72 of attachment assembly 18, and are integrally formed from the material of top bar 72. In other embodiments, securement locations 74, 76 may be positioned elsewhere on attachment assembly 18. In other embodiments, securement locations 74, 76 may be formed from separate components and affixed to attachment assembly 18, for example by bolting, welding, etc.

Implement hoses 68, 70 may then be coupled to quick-connects 40, 42 as shown, such that hydraulic fluid is supplied to hydraulic cylinders 66. For hydraulic implements requiring a case drain connection, an implement case drain hose may be further connected to quick-connect 44. For hydraulic implements requiring electrical power, an implement electrical plug may be further connected to an electrical connection (not shown).

Figure 8:
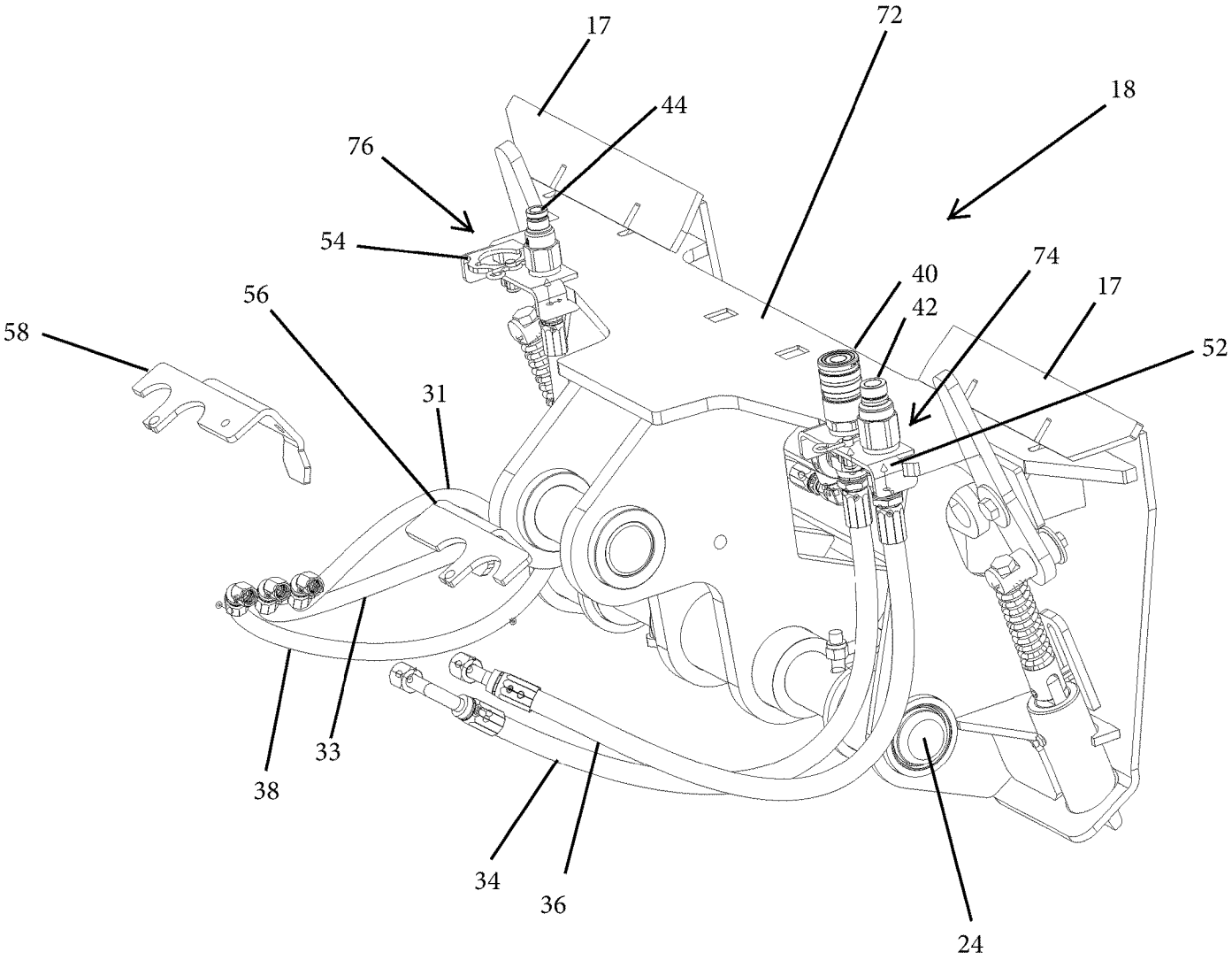
FIG. 8 is a perspective view of components of an attachment assembly having an embodiment of the present invention in an operating position.
Figure 9:
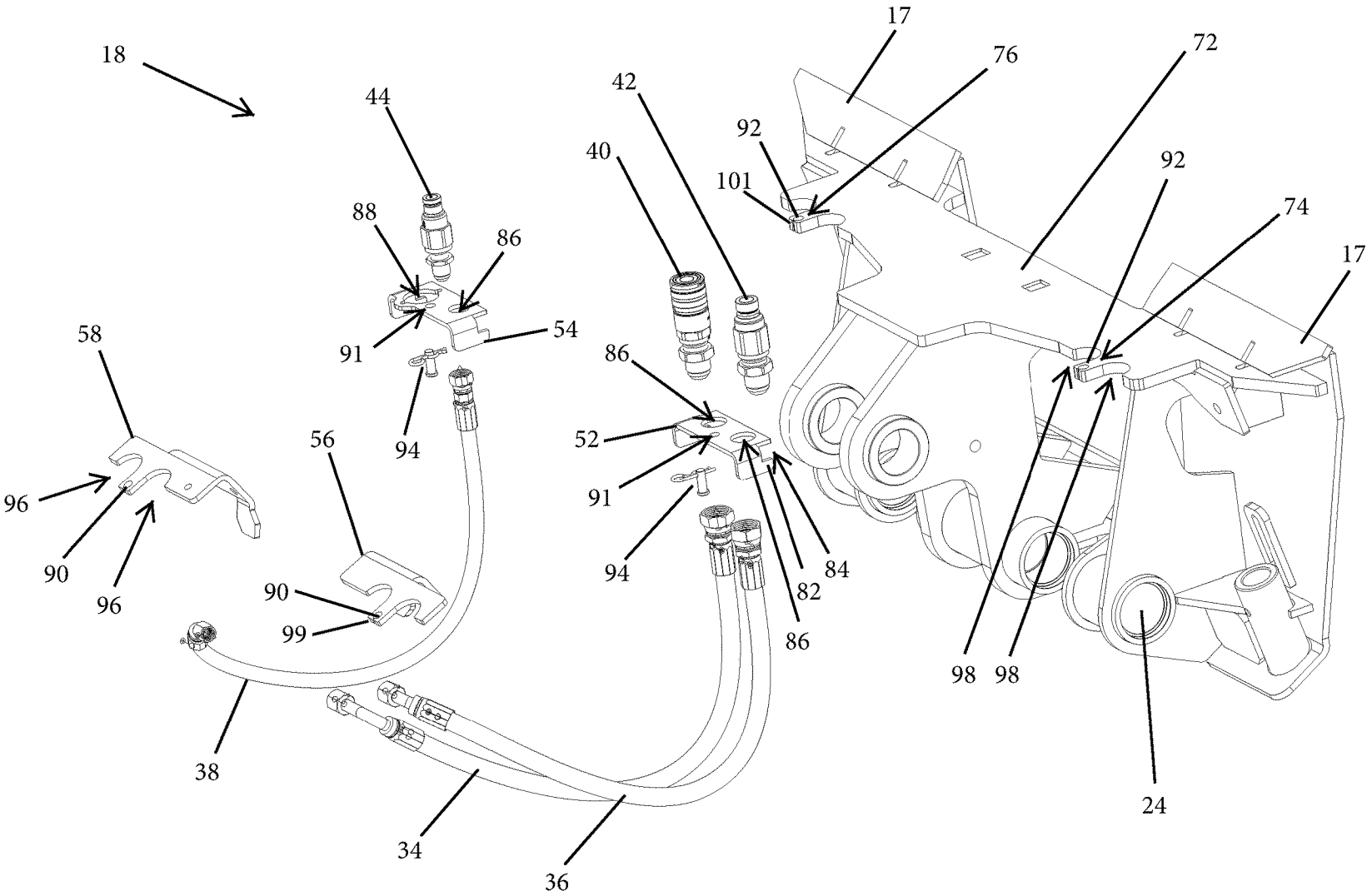
FIG. 9 is an exploded perspective view of components of an attachment assembly having an embodiment of the present invention in an operating position.

Referring to FIGS. 8 and 9, the attachment assembly 18 is shown removed from front end 26 of a lift arm, in assembled and exploded views. Mounting plates 52, 54 include a generally flat body having one or more annular openings 86. Annular openings 86 are sized to receive hydraulic quick-connects 40, 42, 44 received therethrough. In typical embodiments, annular openings 86 are circular with a diameter between 0.25 inches and 1.25 inches. In the preferred embodiment shown, annular openings 86 have a diameter of approximately 1.09 inches for hydraulic lines 35 and 36 and associate quick-connects 40, 42, and approximately 0.90 inches for hydraulic case drain line 38 and associated quick-connect 44.

In the preferred embodiment shown, mounting plate 52 receives hydraulic fluid supply hose and coupling 34, 40 and hydraulic fluid return hose and coupling 36, 42, while mounting plate 54 receives a hydraulic fluid case drain hose and coupling 38, 44 and further includes an annular opening 88 sized to receive an implement electrical supply plug (not shown). Other configurations may also be employed without departing from the scope of the present invention. For example, three hydraulic lines 34, 36, and 38 may be provided on a single mounting plate to provide hydraulic supply, return, and case drain connections. In other embodiments, other arrangements of any number of hydraulic hoses and/or electrical lines may be provided.

In the embodiment shown, mounting plates 52, 54 include a generally flat body 78 securement tabs 82. Securement tabs 82 and body 78 define a slot 84, wherein slot 84 is sized to receive the thickness of brackets 52, 54 and top bar 72 when installed respectively thereupon. As will be appreciated, different geometries for a mounting plate and bracket may be employed to carry out the present invention. In combination with a securement pin or mechanism, securement tabs 82 and body 78 permit the rapid and tool-less positioning of mounting plates 52, 54 and associated hydraulic hoses and electrical lines in non-operating positions on brackets 56, 58 and operating positions 74, 76 respectively.

Brackets 56, 58 are generally flat and each include U-shaped or J-Shaped openings 96 on one side of each bracket, thereby allowing mounting brackets 52, 54 and associated hydraulic hoses to be slidably affixed to and removed from brackets 56, 58 respectively, without removal of the hydraulic hoses from the mounting plate. Similarly, brackets 74, 76 are also generally flat and include U-shaped or J-Shaped openings 98 on one side of each bracket, thereby allowing mounting brackets 52, 54 and associated hydraulic hoses to be slidably affixed to and removed from brackets 74, 76 respectively. In a preferred embodiment, each bracket includes opposed J-shaped openings defining a protrusion 99, 101 respectively therebetween.

Brackets 56, 58 each include an annular opening 90 on protrusion 99 sized to receive a pin 94, bolt, or similar securement mechanism. Each mounting plate 52, 54 may also include an annular opening 91 such that opening 91 is coaxial with opening 90 when mounting plates 52, 54 are engaged with brackets 56, 58 respectively. When brackets 52, 54 are positioned on brackets 56, 58, the mounting plates may be secured in position by a pin 94 passing through openings 90, 91. Brackets 74, 76 of attachment assembly 18 similarly include an annular opening 92 on protrusions 101 that are coaxial with opening 90 when mounting plates 52, 54 are received by brackets 74, 76. Mounting plates 52, 54 may thereby also be secured to attachment assembly 18 during operation of a hydraulically-powered implement.

According to another embodiment of the present invention, two or four brackets (e.g., bracket 52, 74 or brackets 52, 54, 74, and 76) and compatible mounting plates (e.g., mounting plate 52 or plates 52, 54) may be provided as a kit for retrofitting multi-position coupling assemblies of the present invention to existing equipment. Brackets are provided as pairs with a compatible mounting plate, a first bracket associated with the lift arm and a second bracket associated with the attachment assembly. Brackets may thereby be affixed to the lift arm and attachment assembly (bolted, welded, etc.) to provide a multi-position coupling attachment configuration according to the present invention.

In typical embodiments of the present invention, vehicle hydraulic power is supplied to an implement via hoses 34, 36 and quick-connects 40, 42 at a pressure of about 3000 psi. In some embodiments, hydraulic fluid may be supplied to an implement at a standard flow rate of about 18 gpm. In other embodiments, hydraulic fluid may be supplied to an implement at a higher flow rate of about 25-30 gpm. In a typical embodiment, hydraulic fluid is supplied by a hydraulic pump positioned on a vehicle, for example loaders 10 and 12.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lift arm comprising:

an attachment assembly rotatable with respect to the lift arm;

a first hydraulic hose having a first end and a second end, wherein the first end is in fluid connection with a first hydraulic fitting in a fixed relation to the lift arm, and wherein the second end includes a quick connect hydraulic fitting and is coupled to a first mounting plate;

a first bracket affixed to the lift arm; and a second bracket affixed to the attachment assembly, wherein the first mounting plate is moveable between the first bracket and the second bracket, and wherein the first mounting plate is removably securable to the first bracket and the second bracket.

2. The lift arm of claim 1, wherein the first bracket is in a static relationship to the lift arm during rotation of the attachment assembly, and wherein the second bracket is in a rotational relationship to the lift arm during rotation of the attachment assembly.

3. The lift arm of claim 1, wherein the first mounting plate is slidably receivable by the first bracket and the second bracket without decoupling the first hydraulic hose from the first mounting plate.

4. The lift arm of claim 1, wherein the lift arm further comprises a second hydraulic hose having a third end and a fourth end, wherein the third end is in fluid connection with a second hydraulic fitting in a fixed relation to the lift arm, and wherein the fourth end includes a quick connect hydraulic fitting and is coupled to the first mounting plate.

5. The lift arm of claim 4, wherein the quick connect fitting of the first hydraulic hose is a hydraulic fluid supply fitting, and wherein the quick connect fitting of the second hydraulic hose is a hydraulic fluid return fitting.

6. The lift arm of claim 4, wherein the lift arm further comprises:

a third hydraulic hose having a fifth end and a sixth end, wherein the fifth end is in fluid connection with a third hydraulic fitting in a fixed relation to the liftarm, and wherein the sixth end includes a quick connect hydraulic fitting and is coupled to a second mounting plate;

a third bracket affixed to the lift arm; and a fourth bracket affixed to the attachment assembly, wherein the second mounting plate is moveable between the third bracket and the fourth bracket, and wherein the second mounting plate is removably securable to the third bracket and the fourth bracket.

7. The lift arm of claim 6, wherein the second mounting plate is slidably receivable by the third bracket and the fourth bracket without decoupling the third hydraulic hose from the second mounting plate.

8. The lift arm of claim 6, wherein the third hydraulic hose is a case drain hose.

9. A method of selectively securing hydraulic hoses of a vehicle during operation comprising the steps of:

providing a vehicle having a lift arm, the lift arm having an attachment assembly rotatable with respect to the lift arm;

providing a first bracket on the lift arm, the first bracket configured to receive a mounting plate coupled to a first flexible hydraulic hose;

providing a second bracket on the attachment assembly, the second bracket configured to receive the mounting plate coupled to the first flexible hydraulic hose; and selectively securing the mounting plate and the first hydraulic hose to the first bracket when a non-hydraulic implement is coupled to the attachment assembly, and selectively securing the mounting plate and the first hydraulic hose to the second bracket when a hydraulic implement is coupled to the attachment assembly, and further coupling the first hydraulic hose to the hydraulic implement.

10. The method of claim 9, further comprising providing two J-shaped recesses on each of the first bracket and the second bracket, each of the two J-shaped recesses defining a protrusion therebetween.

11. A kit for providing a multi-position coupling arrangement for a lift arm, wherein the lift arm includes a rotatable attachment assembly, the kit comprising:

a first bracket affixable to the lift arm and a second bracket affixed to the attachment assembly, each bracket having a generally flat profile and two recesses defining a protrusion therebetween, each protrusion having a protrusion securement pin opening thereupon;

a mounting plate including an annular opening having a diameter between 0.25 inches and 1.25 inches, and further including a plate securement pin opening; and a first hydraulic hose having a first end and a second end, wherein the first end is in fluid connection with a first hydraulic fitting in a fixed relation to the lift arm, and wherein the second end includes a quick connect hydraulic fitting and is coupled to the mounting plate, wherein the mounting plate is moveable between the first bracket and the second bracket, the mounting plate is removably securable to the first bracket and the second bracket, and the plate securement pin opening and the protrusion securement pin opening are coaxially aligned when the mounting plate is secured to the first bracket or the second bracket.

12. The kit of claim 11, further including a securement pin.

13. The kit of claim 11, wherein the recesses are opposed J-shaped recesses.

14. The kit of claim 11, further including:

a third bracket and a fourth bracket each having a securement pin opening; and a second mounting plate selectively securable to the third bracket and the fourth bracket, wherein the second mounting plate includes an annular hose opening, and further includes a plate opening for.

15. The kit of claim 11, further including two hydraulic hoses.

16. The kit of claim 11, wherein the annular opening has a diameter between about 0.25 inches and about 1.25 inches.

* * * * *